US008975809B2

(12) United States Patent
Nakamura

(10) Patent No.: US 8,975,809 B2
(45) Date of Patent: Mar. 10, 2015

(54) SPARK PLUG

(71) Applicant: NGK Spark Plug Co., Ltd., Nagoya-shi, Aichi (JP)

(72) Inventor: Mai Nakamura, Inazawa (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/359,175

(22) PCT Filed: Dec. 6, 2012

(86) PCT No.: PCT/JP2012/007812

§ 371 (c)(1),
(2) Date: May 19, 2014

(87) PCT Pub. No.: WO2013/094139

PCT Pub. Date: Jun. 27, 2013

(65) Prior Publication Data

US 2014/0346945 A1 Nov. 27, 2014

(30) Foreign Application Priority Data

Dec. 21, 2011 (JP) ..... 2011-279811

(51) Int. Cl.
*H01T 13/20* (2006.01)

(52) U.S. Cl.
CPC ..... *H01T 13/20* (2013.01)
USPC ..... 313/143; 313/145

(58) Field of Classification Search
USPC ..... 313/141–145
See application file for complete search history.

(56) References Cited

U.S. PATENT DOCUMENTS

| | | | | |
|---|---|---|---|---|
| 6,091,185 | A * | 7/2000 | Matsubara et al. | 313/138 |
| 6,310,430 | B1 * | 10/2001 | Moriya | 313/141 |
| 6,373,173 | B1 * | 4/2002 | Suzuki | 313/143 |
| 7,432,641 | B2 * | 10/2008 | Nunome | 313/141 |
| 8,384,278 | B2 * | 2/2013 | Benz et al. | 313/141 |
| 2001/0002096 | A1 | 5/2001 | Honda et al. | 313/143 |
| 2002/0033659 | A1 | 3/2002 | Nishikawa et al. | 313/118 |
| 2005/0116598 | A1 | 6/2005 | Kanao | 313/141 |

FOREIGN PATENT DOCUMENTS

| | | | |
|---|---|---|---|
| JP | 2001-155839 | 6/2001 | H01T 13/20 |
| JP | 2001-319755 | 11/2001 | H01T 13/38 |
| JP | 2005-166291 | 6/2005 | H01T 13/20 |

* cited by examiner

*Primary Examiner* — Mariceli Santiago
(74) *Attorney, Agent, or Firm* — Kusner & Jaffe

(57) ABSTRACT

An ignition plug having a ceramic insulator with an axial bore, a metallic shell provided around the ceramic insulator, and a terminal electrode having a leg portion inserted into a rear end portion of the axial bore and a head portion projecting from the rear end of the ceramic insulator, wherein the length L of a portion of the ceramic insulator projecting from the rear end of the metallic shell is not less than 28 mm but not greater than 34 mm. The thickness t of the thinnest portion of the ceramic insulator is 1.0 mm or greater within a region which extends 5.5 mm from the rear end of the ceramic insulator toward the forward end side with respect to the direction of the axis.

4 Claims, 6 Drawing Sheets

SPARK PLUG

FIELD OF THE INVENTION

The present invention relates to an ignition plug for use in an internal combustion engine or the like.

BACKGROUND OF THE INVENTION

An ignition plug is used in an internal combustion engine or the like, and includes an insulator formed of an insulating ceramic such as alumina and having an axial bore extending in the axial direction thereof. A center electrode is provided in a forward end portion of the axial bore. A terminal electrode is provided in a rear end portion of the axial bore, and a ground electrode which forms a spark discharge gap in cooperation with the center electrode. Spark discharge is generated at the spark discharge gap by applying a predetermined voltage to the spark discharge gap through the terminal electrode.

The terminal electrode includes a head portion which projects from the rear end of the insulator and to which a high tension cable (plug cap) for power supply is attached, and a rod-shaped leg portion which is inserted into the axial bore and whose forward end portion is fixed to the insulator by means of glass seal or the like. The head portion is provided in a state in which a flat-shaped portion of the head portion is in contact with a flat-shaped portion (flat portion) of a rear end surface of the insulator (in some cases, at least a portion of the forward end surface of the head portion may separate from the rear end surface of the insulator).

In recent years, the fuel consumption of an internal combustion engine has been strictly regulated from the viewpoint of environmental protection, etc. In order to prevent a decrease in the output of the internal combustion engine while complying with the regulation on fuel consumption, the displacement of the internal combustion engine has been decreased. A decrease in the output of the engine has been prevented by increasing the degree of compression and the degree of supercharging of the engine.

In an internal combustion engine having an increased degree of compression and an increased degree of supercharging, a higher voltage is needed so as to generate spark discharge. However, when the applied voltage is increased, current may leak from the terminal electrode to the metallic shell while creeping along the surface of the insulator, and misfire may occur due to discharge anomaly. In view of this, there has been proposed increasing the length of a portion (rear trunk portion) of the insulator located between the rear end of the metallic shell and the head portion of the terminal electrode to thereby prevent leakage of current (so-called flashover) (see, for example, Japanese Patent Application Laid-Open (kokai) No. 2001-155839).

Moreover, in recent years, an ignition plug has been demanded to have a reduced size; in particular, a reduced diameter, and the insulator thereof may have a reduced diameter in order to meet such demand. In the case of the insulator having a reduced diameter, the wall thickness of the rear end portion is decreased, and the area of the above-mentioned flat portion of the insulator is decreased.

Incidentally, when a vibration generated as a result of operation of an internal combustion engine or the like acts on an ignition plug used therein, the head portion of the terminal electrode shakes, with a forward end portion of the leg potion fixed to the insulator serving as the center of the shaking motion, whereby the leg portion may come into contact with the inner circumference surface of a rear end portion of the insulator. In the case where the wall thickness of the rear end portion of the insulator is small, breakage such as cracking may occur on the inner circumferential surface of the rear end portion of the insulator as a result of the contact with the leg portion.

Also, the vibration applies a load onto the head portion of the terminal electrode in a direction intersecting with the axis, and due to this load, the forward end surface of the head portion may be pressed against the flat portion of the insulator. When the forward end surface of the head portion is pressed against (comes into pressure contact with) the insulator, a compressive load acts on a portion of the insulator against which the head portion is pressed, and a tensile load acts on a portion of the insulator adjacent to the portion on which the compressive load acts. Since the insulator is strong against compressive load but relatively weak against tensile load due to its nature, the above-mentioned tensile load may cause breakage at the rear end surface (flat portion) of the insulator.

In particular, in the case of an insulator in which the length of its rear trunk portion is increased and/or the area of the above-mentioned flat portion of the insulator is decreased, breakage is more likely to occur.

The present invention has been conceived in view of the above circumstances. An advantage of the invention is an ignition plug which can prevent breakage at a rear end portion of an insulator even in the case where a rear trunk portion of the insulator is long and/or the area of a flat portion of the insulator is small.

SUMMARY OF THE INVENTION

Configurations suitable for achieving the above advantage will next be described in itemized form. When needed, actions and effects peculiar to the configurations will be described additionally.

Configuration 1. In accordance with a first aspect of the present invention, there is provided an ignition plug of the present configuration comprised of:

an insulator having an axial bore extending in a direction of an axis;

a center electrode inserted into a forward end portion of the axial bore;

a terminal electrode having a rod-shaped leg portion inserted into a rear end portion of the axial bore, and a head portion projecting from a rear end of the insulator; and a tubular metallic shell disposed around the insulator such that a portion of the insulator projects from a rear end of the metallic shell, a length L of the portion of the insulator projecting from the rear end of the metallic shell measured along the axis being not less than 28 mm but not greater than 34 mm, wherein, a thickness t of a thinnest portion of the insulator is 1.0 mm or greater within a region which extends 5.5 mm from the rear end of the insulator toward the forward end side with respect to the direction of the axis;

a forward end surface of the head portion and a rear end surface of the insulator have respective flat portions; and when the flat portion of the rear end surface of the insulator and the flat portion of the forward end surface of the head portion are projected along the axis onto a plane orthogonal to the axis, an area D of a region where a projected area of the flat portion of the rear end surface overlaps with a projected area of the flat portion of the forward end surface is set to 8 $mm^2$ or greater.

Notably, the "region which extends 5.5 mm from the rear end of the insulator toward the forward end side with respect to the direction of the axis" means a region in which the leg portion may come into contact with the insulator when the head portion shakes. Accordingly, in the case where the axial bore has a larger diameter portion which is located within the above-mentioned region and whose diameter is greater than that of the remaining portion of the axial bore, and the leg portion does not come into contact with a portion of the insulator corresponding to the larger diameter portion, that portion of the insulator is excluded from the portion whose thickness is set to 1.0 mm or greater. Namely, even the portion of the insulator located within the above-mentioned region can have a thickness less than 1.0 mm in a region where the leg portion does not come into contact with that portion of the insulator due to shaking of the head portion (this applies to the following configurations).

Configuration 2. In accordance with a second aspect of the present invention, there is provided an ignition plug as described above in Configuration 1, wherein the flat portion of the rear end surface of the insulator has an area of 25 $mm^2$ or less.

Configuration 3. In accordance with a third aspect of the present invention, there is provided an ignition plug of the present configuration comprised of:

an insulator having an axial bore extending in a direction of an axis;

a center electrode inserted into a forward end portion of the axial bore;

a terminal electrode having a rod-shaped leg portion inserted into a rear end portion of the axial bore, and a head portion projecting from a rear end of the insulator; and a tubular metallic shell disposed around the insulator, wherein, a thickness t of a thinnest portion of the insulator is 1.0 mm or greater within a region which extends 5.5 mm from the rear end of the insulator toward the forward end side with respect to the direction of the axis;

a forward end surface of the head portion and a rear end surface of the insulator have respective flat portions;

the flat portion of the rear end surface of the insulator has an area of 25 $mm^2$ or less; and when the flat portion of the rear end surface of the insulator and the flat portion of the forward end surface of the head portion are projected along the axis onto a plane orthogonal to the axis, an area D of a region where a projected area of the flat portion of the rear end surface overlaps with a projected area of the flat portion of the forward end surface is set to 8 $mm^2$ or greater.

Configuration 4. In accordance with a fourth aspect of the present invention, there is provided an ignition plug as described in any of Configurations 1 to 3, wherein a part of the head portion located within a region which extends at least 2 mm from the forward end of the head portion toward the rear end side with respect to the direction of the axis has an outer diameter equal to or greater than that of the forward end surface of the head portion.

According to the ignition plug of Configuration 1, the length L is set to 28 mm or greater. Therefore, a high degree of insulation can be obtained between the head portion of the terminal electrode and the metallic shell, whereby leakage of current between the head portion and the metallic shell can be prevented more reliably. However, when the length L is set to 28 mm or greater, the rear end portion of the insulator becomes likely to break due to vibration.

According to the ignition plug of Configuration 1, the thickness t of the thinnest portion of the insulator is 1.0 mm or greater within the region which extends 5.5 mm from the rear end of the insulator toward the forward end side with respect to the axial direction. Namely, the thickness of a portion of the insulator with which the leg portion may come into contact due to shaking of the head portion is set to 1.0 mm or greater. Accordingly, the insulator has sufficient strength against the contact with the leg portion, whereby it becomes possible to more reliably prevent breakage at the rear end portion of the insulator, which breakage would otherwise occur due to contact with the leg portion.

Further, according to the above-described Configuration 1, when the flat portion of the insulator and the flat portion of the head portion are projected along the axis onto a plane orthogonal to the axis, the area D of the region where the projected area of the flat portion of the insulator and the projected area of the flat portion of the head portion overlap with each other is set to 8 $mm^2$ Accordingly, the compressive force which is applied from the head portion to the rear end surface of the ceramic insulator due to vibration can be dispersed effectively, whereby the tensile load acting on the insulator can be decreased more reliably. As a result, it becomes possible to more reliably prevent breakage at the rear end portion of the insulator, which breakage would otherwise occur due to pressure contact with the head portion.

As described above, according to the above-described Configuration 1, the thickness t is set to 1.0 mm or greater and the area D is set to 8 $mm^2$ or greater, whereby both of the breakage attributable to contact with the leg portion and the breakage attributable to pressure contact with the head portion can be prevented more reliably even in the case where the length L is 28 mm or greater and the rear end portion of the insulator is likely to break. As a result, breakage at the rear end portion of the insulator can be prevented effectively.

Moreover, in the case where the length L is greater than 34 mm, when a load is applied to the head portion, breakage may occur in a front-end-side part (part located near the metallic shell) of the portion (rear trunk portion) of the insulator which projects from the metallic shell. However, according the above-described Configuration 1, since the length L is set to 34 mm or less, breakage at the front-end-side part of the rear trunk portion can be prevented effectively. As a result, combined with the effect of preventing breakage at the rear end portion of the insulator which is achieved by setting the thickness t to 1.0 mm and setting the area D to 8 $mm^2$ or greater, setting the length L to 34 mm or less makes it possible to more reliably prevent occurrence of breakage at various portions of the insulator.

According to the ignition plug of Configuration 2, the area of the flat portion of the insulator is set to 25 $mm^2$ or less. Therefore, the rear end portion of the insulator is likely to have a relatively low strength. Accordingly, the rear end portion of the insulator is more likely to break. However, through employment of the above-described Configuration 1, breakage at the rear end portion of the insulator can be prevented more reliably. In other words, above-described Configuration 1 is particularly effective in an ignition plug in which the length L is set to 28 mm or greater, the area of the flat portion of the insulator is set to 25 $mm^2$ or less, and therefore, the rear end portion of the insulator is more likely to break.

In the case where the area of the flat portion of the insulator is small, the rear end portion of the insulator is likely to have a relatively low strength. Therefore, in the case where the area of the flat portion of the insulator is set to 25 $mm^2$ or less as in the case of the ignition plug of Configuration 3, breakage at the rear end portion of the insulator due to vibration is more likely to occur.

According to the ignition plug of Configuration 3, the above-mentioned thickness t is set to 1.0 mm or greater. Therefore, the insulator has sufficient strength against contact with the leg portion, whereby breakage at the rear end portion of the insulator due to contact with the leg portion can be prevented more reliably.

Also, since the area D is set to 8 $mm^2$ or greater, the tensile load acting on the insulator can be decreased more reliably, whereby breakage at the rear end portion of the insulator due to pressure contact with the head portion can be prevented more reliably.

As described above, according to the above-described Configuration 3, breakage at the rear end portion of the insulator can be prevented effectively even in the case where the area of the flat portion of the insulator is set to 25 $mm^2$ or less, and the rear end portion of the insulator is likely to break.

Also, since the length L is set to 34 mm or less, it is possible to effectively prevent the breakage at the front-end-side part of the rear trunk portion, which breakage would otherwise occur when a load acts on the head portion.

According to the ignition plug of Configuration 4, the part of the head portion located within a region which extends at least 2 mm from the forward end of the head portion toward the rear end side with respect to the axial direction has an outer diameter equal to or greater than that of the forward end surface of the head portion. Namely, a portion of the head portion which comes into contact with the rear end surface of the insulator has a thickness of 2 mm or greater in the axial direction. Therefore, the load applied from the head portion to the rear end surface of the insulator due to vibration tends to become large, and the rear end portion of the ceramic insulator is highly likely to break. However, through employment of the above-described Configuration 1, etc., breakage at the rear end portion of the insulator can be prevented more reliably. In other words, above-described Configuration 1, etc. are particularly effective in the case where the part of the head portion located within the region which extends at least 2 mm from the forward end of the head portion toward the rear end side with respect to the axial direction has an outer diameter equal to or greater than that of the forward end surface of the head portion.

DETAILED DESCRIPTION OF PREFERRED EMBODIMENTS

Figure 1:
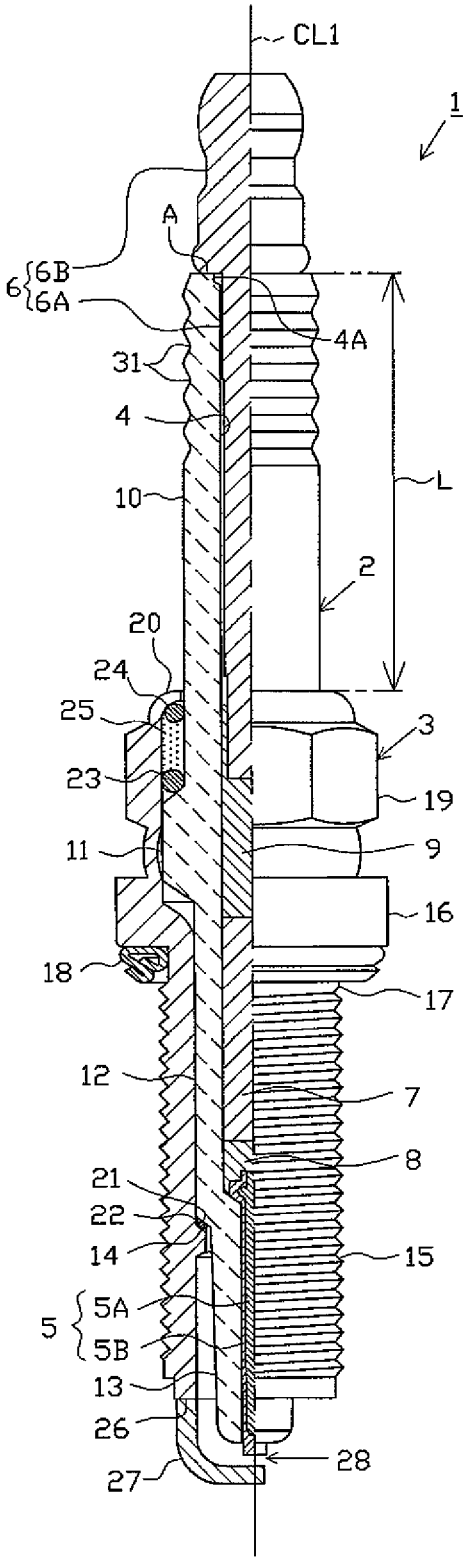
FIG. 1 is a partially cutaway front view showing the structure of an ignition plug.

One embodiment will now be described with reference to the drawings. FIG. 1 is a partially cutaway front view showing an ignition plug 1. In FIG. 1, the direction of an axis CL1 of the ignition plug 1 is referred to as the vertical direction. In the following description, the lower side of FIG. 1 is referred to as the forward end side of the spark plug 1, and the upper side of FIG. 1 is referred to as the rear end side of the spark plug 1.

The ignition plug 1 includes a tubular ceramic insulator 2 which corresponds to the insulator in the claims, a tubular metallic shell 3 which holds the ceramic insulator 2 therein, etc.

The ceramic insulator 2 is formed from alumina or the like by firing, as well known in the art. The ceramic insulator 2, as viewed externally, includes a rear trunk portion 10 formed at its rear end side; a large-diameter portion 11 located forward of the rear trunk portion 10 and projecting radially outward; an intermediate trunk portion 12 located forward of the large-diameter portion 11 and being smaller in diameter than the large-diameter portion 11; and a leg portion 13 located forward of the intermediate trunk portion 12 and being smaller in diameter than the intermediate trunk portion 12. The large-diameter portion 11, the intermediate trunk portion 12, and the greater part of the leg portion 13 of the ceramic insulator 2 are accommodated within the metallic shell 3. The rear trunk portion 10 of the ceramic insulator 2 projects from the rear end of the metallic shell 3. A tapered, stepped portion 14 is formed at a connection portion between the intermediate trunk portion 12 and the leg portion 13. The ceramic insulator 2 is seated on the metallic shell 3 at the stepped portion 14.

The rear trunk portion 10 has a plurality of annular grooves 31 extending along its circumferential direction and formed at predetermined intervals along the direction of the axis CL1. The grooves 31 increase a creeping distance, measured along the surface of the ceramic insulator 2, between a head portion 6B of a terminal electrode 6, which will be described later, and the rear end of the metallic shell 3.

The ceramic insulator 2 has an axial bore 4 extending therethrough along the axis CL1. A center electrode 5 is fixedly inserted into a forward end portion of the axial bore 4. The center electrode 5 includes an inner layer 5A formed of a metal having excellent thermal conductivity [e.g., copper, a copper alloy, or pure nickel (Ni)], and an outer layer 5B formed of an alloy which contains Ni as a main component. The center electrode 5 assumes a rodlike (circular columnar) shape as a whole, and its forward end portion protrudes from the forward end of the ceramic insulator 2.

A rod-shaped terminal electrode 6 formed of a metal such as low-carbon steel is provided in a rear end portion of the axial bore 4. The terminal electrode 6 has a rod-shaped leg portion 6A which is inserted into the rear end portion of the axial bore 4, and a head portion 6B which is greater in diameter than the leg portion 6A and which projects from the rear end of the ceramic insulator 2.

In the present embodiment, in order to facilitate insertion of the leg portion 6A into the axial bore 4, an annular gap is formed between the outer circumferential surface of the leg portion 6A and the wall surface of the axial bore 4. The axial bore 4 has a diameter-increased portion 4A at the rearmost end of thereof. The diameter of the diameter-increased portion 4A is greater than the diameter of a portion of the axial bore 4 located adjacent to and forward of the diameter-increased portion 4A. A relatively large gap is formed between the leg portion 6A and the diameter increased portion 4A. A high tension cable or the like for power supply (not shown) is attached to the head portion 6B.

Figure 2:
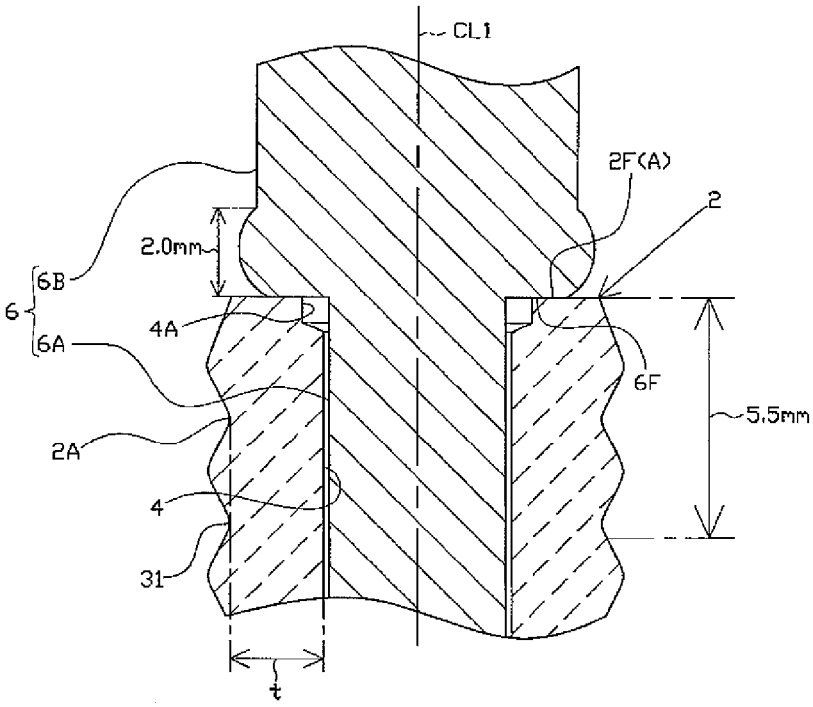
FIG. 2 is an enlarged sectional view showing the structures of a terminal electrode and a ceramic insulator.

As shown in FIG. 2, a flat portion 6F having a planar shape is provided on a forward end surface of the head portion 6B. In the present embodiment, the flat portion 6F is in contact with a flat portion 2F provided on a rear end surface of the ceramic insulator 2 and has a planar shape. In the present embodiment, in order to reduce the size of the ignition plug 1, the diameter of the ceramic insulator 2 is reduced. Therefore, the area A of the flat portion 2F of the ceramic insulator 2 is set to a predetermined value (e.g., not less than 10 $mm^2$ but not greater than 25 $mm^2$). A layer of glaze is provided on the outer surface of at least a portion (e.g., the rear trunk portion 10) of the ceramic insulator 2. The layer of glaze may be provided on the flat portion 2F.

In the present embodiment, a part of the head portion 6B located in a region which extends at least 2 mm from the forward end of the head portion 6B toward the rear end side with respect to the direction of the axis CL1 has an outer diameter equal to or greater than the outer diameter of the forward end surface of the head portion 6B. Namely, a portion of the head portion 6B which comes into contact with the rear end surface of the ceramic insulator 2 has a thickness of at least 2 mm or more.

Referring back to FIG. 1, a circular columnar resistor 7 is disposed within the axial bore 4 to be located between the center electrode 5 and the terminal electrode 6. Glass seal layers 8 and 9 are provided on opposite sides, respectively, of the resistor 7. The glass seal layers 8 and 9 are formed by firing a glass powder mixture which contains an electrically conductive material (e.g., carbon black) and glass powder. In the present embodiment, a forward end portion of the terminal electrode 6 (the leg portion 6A) is fixed to the ceramic insulator 2 by the glass seal layer 9.

The metallic shell 3 is formed into a tubular shape from low-carbon steel or a like metal. The metallic shell 3 has a threaded portion (externally threaded portion) 15 which is formed on the outer circumferential surface of a forward end portion thereof. The threaded portion 15 is used to mount the ignition plug 1 onto a combustion apparatus such as an internal combustion engine or a fuel cell reformer. The metallic shell 3 also has a seat portion 16 located rearward of the threaded portion 15 and protruding radially outward. A ring-shaped gasket 18 is fitted to a screw neck 17 at the rear end of the threaded portion 15. Furthermore, the metallic shell 3 has, near the rear end thereof, a tool engagement portion 19 having a hexagonal cross section and allowing a tool, such as a wrench, to be engaged therewith when the metallic shell 3 is to be mounted to the combustion apparatus. Also, the metallic shell 3 has a crimped portion 20 which is provided at the rear end thereof and which curves toward the radially inner side.

Also, the metallic shell 3 has, on its inner circumferential surface, a tapered, stepped portion 21 adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimped portion 20 is formed, whereby the ceramic insulator 2 is fixed to the metallic shell 3. An annular sheet packing 22 intervenes between the above-mentioned stepped portions 14 and 21. This retains airtightness of a combustion chamber and prevents outward leakage of fuel gas entering a clearance between the leg portion 13 of the ceramic insulator 2 and the inner circumferential surface of the metallic shell 3, the clearance being exposed to the combustion chamber.

Furthermore, in order to ensure airtightness which is established by crimping, annular ring members 23 and 24 intervene between the metallic shell 3 and the ceramic insulator 2 in a region near the rear end of the metallic shell 3, and a space between the ring members 23 and 24 is filled with powder of talc 25. That is, the metallic shell 3 holds the ceramic insulator 2 via the sheet packing 22, the ring members 23 and 24, and the talc 25.

A ground electrode 27 is joined to a forward end portion 26 of the metallic shell 3 and is bent toward the center electrode 5 such that a side surface of a distal end portion of the ground electrode 27 faces a forward end surface of the center electrode 5. A spark discharge gap 28 is formed between the forward end surface of the center electrode 5 and the side surface of the distal end portion of the ground electrode 27. Spark discharges are performed across the spark discharge gap 28 substantially along the axis CL1.

In the present embodiment, the length L of a portion of the ceramic insulator 2, which portion projects from the rear end of the metallic shell 3, measured along the axis CL1 is set to fall within a range of 28 mm to 34 mm. Making the length L relatively large, coupled with provision of the grooves 31 to increase the creeping distance as described above, greatly enhances the insulation between the head portion 6B and the metallic shell 3. As a result, occurrence of leakage of current between the head portion 6B and the metallic shell 3 (flashover) can be restrained effectively.

Incidentally, as described above, a gap is present between the outer circumferential surface of the leg portion 6A and the wall surface of the axial bore 4. A forward end portion of the terminal electrode 6 is fixed to the ceramic insulator 2 by the glass seal layer 9. Therefore, when a vibration generated as a result of operation of an internal combustion engine or the like acts on the ignition plug 1, the head portion 6B (on which a large acceleration acts because a high tension cable or the like is attached to the head portion 6B) may shake, with a forward end portion of the terminal electrode 6 (the leg potion 6A) serving as the center of the shaking motion. When the head portion 6B shakes, a rear end portion of the leg portion 6A comes into contact with the inner circumference surface of a rear end portion of the ceramic insulator 2, and breakage (cracking or the like) may occur on the inner circumferential surface of the rear end portion of the ceramic insulator 2.

In view of this, in the present embodiment, as shown in FIG. 2, the thickness t of a thinnest portion 2A of the ceramic insulator 2 is set to 1.0 mm or greater in a region which extends 5.5 mm from the rear end of the ceramic insulator 2 toward the forward end side with respect to the direction of the axis CL1. This setting is performed for preventing breakage of the ceramic insulator 2, which breakage would otherwise occur when the leg portion 6A comes into contact with the inner circumference surface of the rear end portion of the ceramic insulator 2.

Notably, the "region which extends 5.5 mm from the rear end of the ceramic insulator 2 toward the forward end side with respect to the direction of the axis CL1" means a region in which the leg portion 6A may come into contact with the ceramic insulator 2 when the head portion 6B shakes. Accordingly, in the case where the diameter increased portion 4A is provided at the rearmost end of the axial bore 4 as in the present embodiment and the leg portion 6A does not come into contact with the wall surface of the diameter increased portion 4A even when the head portion 6B shakes, a portion of the ceramic insulator 2 where the diameter increased portion 4A is located is excluded from the thinnest portion 2A whose thickness is set to 1.0 mm or greater.

Incidentally, when the vibration of the spark plug 1 applies a load onto the head portion 613 in a direction intersecting the axis CL1, the forward end surface (the flat portion 6F) of the head portion 6B may be pressed against (come into pressure contact with) the rear end surface (the flat portion 2F) of the ceramic insulator 2. When the forward end surface of the head portion 6B is pressed against the rear end surface of the ceramic insulator 2, a tensile load acts on the rear end surface of the ceramic insulator 2, and due to this tensile load, breakage (cracking) may occur at the ear end surface of the ceramic insulator 2.

Figure 3:
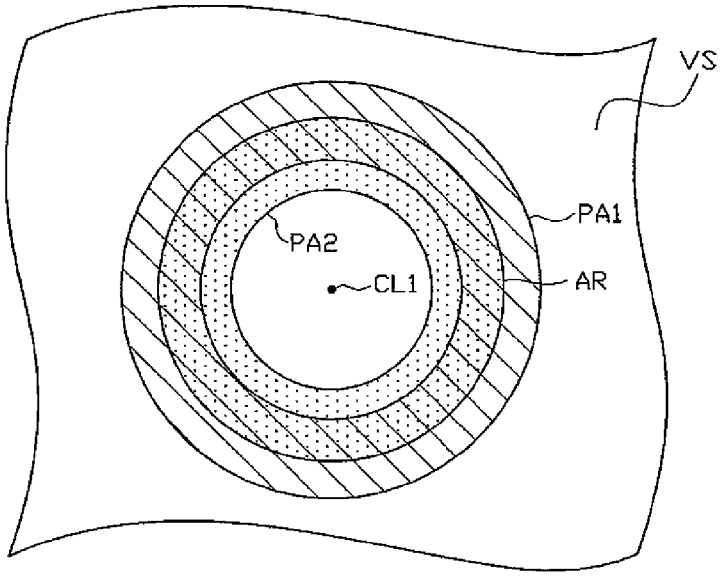
FIG. 3 is a projection view showing a projected area of a flat portion of the terminal electrode and a projected area of a flat portion of the ceramic insulator.

In view of this, in the present embodiment, breakage of the ceramic insulator 2 due to the pressure contact with the head portion 6B is prevented as follows. Specifically, when the flat portion 2F of the ceramic insulator 2 and the flat portion 6F of the head portion 6B are projected along the axis CL1 onto a plane VS orthogonal to the axis CL1 as shown in FIG. 3, the area D of a region AR where a projected area PA1 (a hatched portion in FIG. 3) of the flat portion 2F and a projected area PA2 (a dotted portion in FIG. 3) of the flat portion 6F overlap with each other is set to 8 $mm^2$ or greater.

As having been described in detail, according to the present embodiment, the thickness t of the thinnest portion 2A of the ceramic insulator 2 is set to 1.0 mm or greater in the region which extends 5.5 mm from the rear end of the ceramic insulator 2 toward the forward end side with respect to the direction of the axis CL1. Namely, the thickness of a portion of the ceramic insulator 2 with which the leg portion 6A may come into contact as a result of shaking of the head portion is set to 1.0 mm or greater. Accordingly, the ceramic insulator 2 has sufficient strength against the contact with the leg portion 6A, whereby it becomes possible to more reliably prevent breakage at the rear end portion of the ceramic insulator 2, which breakage would otherwise occur due to contact with the leg portion 6A.

Also, since the above-mentioned area D is set to 8 $mm^2$, the compressive force which is applied from the head portion 6B to the rear end surface of the ceramic insulator 2 due to vibration can be dispersed effectively, whereby the tensile load acting on the ceramic insulator 2 can be decreased more reliably. As a result, it becomes possible to more reliably prevent breakage at the rear end portion of the ceramic insulator 2, which breakage would otherwise occur due to pressure contact with the head portion 6B.

Moreover, in the present embodiment, since the length L is set to 34 mm or less, when a load acts on the head portion 6B, breakage at a forward end portion of the rear trunk portion 10 (on the inner circumferential side of the crimp portion 20) can be prevented effectively. As a result, combined with the effect of preventing breakage at the rear end portion of the ceramic insulator 2 which is achieved by setting the thickness t to 1.0 mm and setting the area D to 8 $mm^2$ or greater, setting the length L to 34 mm or less makes it possible to more reliably prevent occurrence of breakage at various portions of the ceramic insulator 2.

In particular, in the case where the length L is set to 28 mm or greater, the area of the flat portion 2F is set to 25 $mm^2$ or less, and the outer diameter of a forward end part of the head portion 6B, which part has a length of at least 2 mm, is rendered equal to or greater than the outer diameter of the forward end surface of the head portion 6B as in the present embodiment, breakage is very likely to occur at the rear end portion of the ceramic insulator 2. However, when the thickness t and the area D are determined in the above-described manner, breakage of the ceramic insulator 2 can be prevented more reliably.

Notably, in the present embodiment, the length L is set to 28 mm or greater, the area of the flat portion 2F is set to 25 $mm^2$ or less, and, for the ceramic insulator 2 which is very likely to suffer breakage at the rear end portion thereof, the thickness t is set to 1.0 mm or greater, and the area D is set to 8 $mm^2$ or greater. However, for a ceramic insulator in which the length L is less than 28 mm and the area of the flat portion 2F is set to 25 $mm^2$ or less (a ceramic insulator which is likely to suffer breakage at the rear end portion thereof although the likelihood is lower than that in the case of the ceramic insulator 2 of the above-described embodiment), the thickness t may be set to 1.0 mm or greater, and the area D may be set to 8 $mm^2$ or greater. Also, for a ceramic insulator in which the area of the flat portion 2F is greater than 25 $mm^2$ and the length L is set to 28 mm or greater (a ceramic insulator which is likely to suffer breakage at the rear end portion thereof although the likelihood is lower than that in the case of the ceramic insulator 2 of the above-described embodiment), the thickness t may be set to 1.0 mm or greater, and the area D may be set to 8 $mm^2$ or greater.

Figure 4:
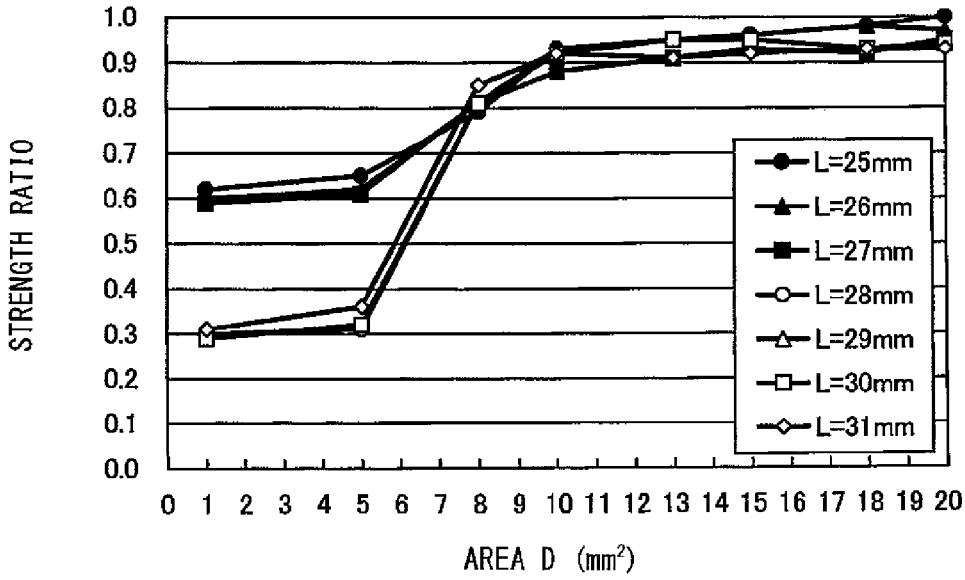
FIG. 4 is a graph showing the results of a cracking load evaluation test performed on samples in which a length L and an area D were changed within respective ranges.
Figure 5:
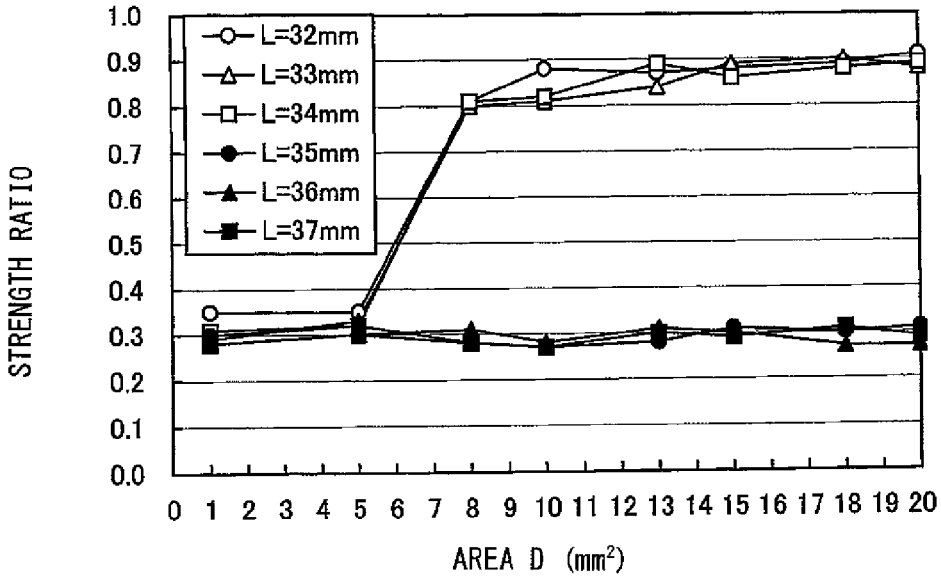
FIG. 5 is a graph showing the results of a cracking load evaluation test performed on samples in which the length L and the area D were changed within respective ranges.

In order to confirm the action and effects achieved by the above-described embodiment, a cracking load evaluation test was performed on samples of the ignition plug which were manufactured while the above-mentioned length L was changed in a range of 25 mm to 37 mm and the above-mentioned area D ($mm^2$) was changed within a predetermined range. The outline of the cracking load evaluation test is as follows. Namely, a sample was attached to a predetermined test bench, and a load was applied to the head portion of the terminal electrode in a direction orthogonal to the axis by using a predetermined autograph (speed: 1 mm/min) A load (cracking load) at the time when the ceramic insulator cracked was measured, and the ratio (strength ratio) of the measured cracking load to the cracking load of a sample in which the length L was set to 25 mm and the area D was set to 20 $mm^2$ was calculated. FIG. 4 shows the test results of samples in which the length L was set in a range of 25 mm to 31 mm, and FIG. 5 shows the test results of samples in which the length L was set in a range of 32 mm to 37 mm.

In FIG. 4, the test results of samples in which the length L was set to 25 mm are indicated by black circles; the test results of samples in which the length L was set to 26 mm are indicated by black triangles; the test results of samples in which the length L was set to 27 mm are indicated by black squares; the test results of samples in which the length L was set to 28 mm are indicated by white circles; the test results of samples in which the length L was set to 29 mm are indicated by white triangles; the test results of samples in which the length L was set to 30 mm are indicated by white squares; and the test results of samples in which the length L was set to 31 mm are indicated by white rhombuses. In FIG. 5, the test results of samples in which the length L was set to 32 mm are indicated by white circles; the test results of samples in which the length L was set to 33 mm are indicated by white triangles; the test results of samples in which the length L was set to 34 mm are indicated by white squares; the test results of samples in which the length L was set to 35 mm are indicated by black circles; the test results of samples in which the length L was set to 36 mm are indicated by black triangles; and the test results of samples in which the length L was set to 37 mm are indicated by black squares.

Notably, for reference, the strength ratio of each sample is shown in Table 1. In each sample, the thickness t of the thinnest portion of the ceramic insulator was set to 1.5 mm.

TABLE 1

| | Area D ($mm^2$) | | | | | | | |
|---|---|---|---|---|---|---|---|---|
| | 1 | 5 | 8 | 10 | 13 | 15 | 18 | 20 |
| L = 25 mm | 0.62 | 0.65 | 0.79 | 0.93 | 0.95 | 0.96 | 0.98 | 1.00 |
| L = 26 mm | 0.60 | 0.62 | 0.81 | 0.93 | 0.95 | 0.96 | 0.98 | 0.97 |
| L = 27 mm | 0.59 | 0.61 | 0.81 | 0.88 | 0.91 | 0.93 | 0.92 | 0.25 |
| L = 28 mm | 0.30 | 0.31 | 0.81 | 0.92 | 0.95 | 0.95 | 0.93 | 0.94 |
| L = 29 mm | 0.29 | 0.32 | 0.81 | 0.92 | 0.95 | 0.95 | 0.93 | 0.94 |
| L = 30 mm | 0.29 | 0.32 | 0.81 | 0.92 | 0.95 | 0.95 | 0.93 | 0.94 |
| L = 31 mm | 0.31 | 0.36 | 0.85 | 0.92 | 0.91 | 0.92 | 0.93 | 0.93 |
| L = 32 mm | 0.35 | 0.35 | 0.81 | 0.88 | 0.87 | 0.88 | 0.89 | 0.91 |
| L = 33 mm | 0.29 | 0.33 | 0.80 | 0.81 | 0.84 | 0.89 | 0.90 | 0.88 |
| L = 34 mm | 0.31 | 0.32 | 0.81 | 0.82 | 0.89 | 0.86 | 0.88 | 0.89 |
| L = 35 mm | 0.30 | 0.32 | 0.28 | 0.27 | 0.28 | 0.31 | 0.30 | 0.31 |
| L = 36 mm | 0.28 | 0.30 | 0.31 | 0.28 | 0.31 | 0.30 | 0.27 | 0.27 |
| L = 37 mm | 0.28 | 0.30 | 0.28 | 0.27 | 0.30 | 0.29 | 0.31 | 0.29 |

It was confirmed that, as shown in FIG. 4, FIG. 5, and Table 1, in the case of the samples in which the length L was set to 28 mm or greater, the strength ratio decreases greatly in some cases, and the ceramic insulator is likely to crack. Notably, in the case of the samples in which the length L was set to 35 mm or greater, the ceramic insulator cracked at a portion located on the inner side of the crimp portion, and, in the case of the samples in which the length L was set to be not less than 28 mm but not greater than 34 mm, the ceramic insulator cracked at a rear end portion thereof even though the ceramic insulator did not crack at the portion located on the inner side of the crimp portion.

As described above, it was found that, of the samples in which cracking occurs at the rear end portion of the ceramic insulator (namely, the samples in which the length L was set to be not less than 28 mm but not greater than 34 mm), the samples in which the area D was set to 8 $mm^2$ or greater (samples whose test results are indicated by white marks in FIGS. 4 and 5) have very high strength ratios and are excellent in the effect of restricting cracking of the ceramic insulator. Conceivably, this advantageous effect was attained for the following reason. Since the area D was set to 8 $mm^2$ or greater, when a load is applied to the head portion of the terminal electrode, the load applied from the head portion of the terminal electrode to the rear end surface of the ceramic insulator was dispersed, and the tensile load acting on the rear end portion of the ceramic insulator decreased.

Figure 6:
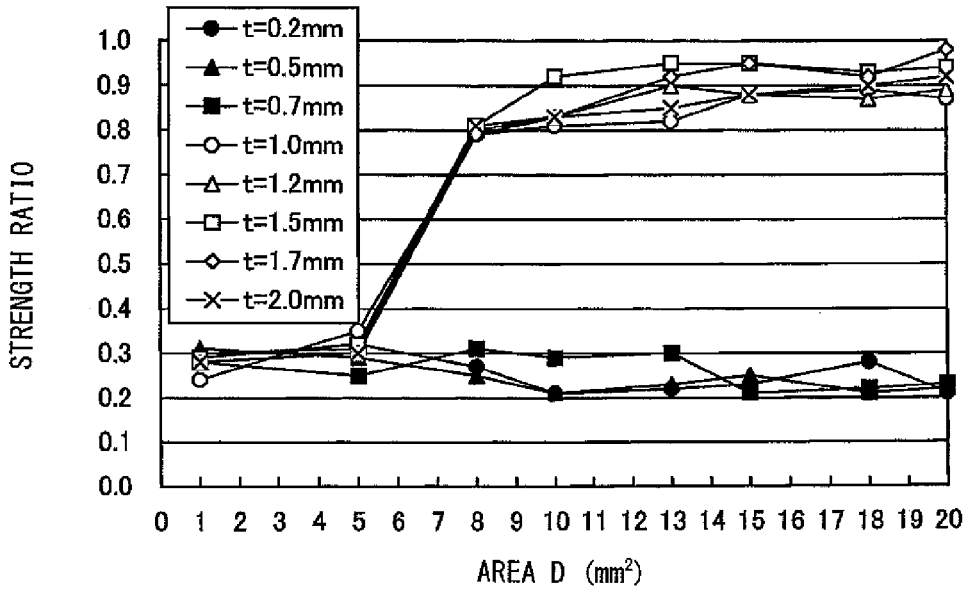
FIG. 6 is a graph showing the results of a cracking load evaluation test performed on samples in which a thickness t and the area D were changed within respective ranges.

Next, there were manufactured samples of the ignition plug in which the length L was set to 30 mm and the above-mentioned thickness t (mm) and the above-mentioned area D ($mm^2$) were changed within respective ranges, and the above-described cracking load evaluation test was performed on the samples. FIG. 6 shows the results of the test.

In FIG. 6, the test results of samples in which the thickness t was set to 0.2 mm are indicated by black circles; the test results of samples in which the thickness t was set to 0.5 mm are indicated by black triangles; and the test results of samples in which the thickness t was set to 0.7 mm are indicated by black squares. Also, the test results of samples in which the thickness t was set to 1.0 mm are indicated by white circles; the test results of samples in which the thickness t was set to 1.2 mm are indicated by white triangles; the test results of samples in which the thickness t was set to 1.5 mm are indicated by white squares; the test results of samples in which the thickness t was set to 1.7 mm are indicated by white rhombuses; and the test results of samples in which the thickness t was set to 2.0 mm are indicated by X. Notably, for reference, the strength ratio of each sample is shown in Table 2.

TABLE 2

| | Area D ($mm^2$) | | | | | | | |
|---|---|---|---|---|---|---|---|---|
| | 1 | 5 | 8 | 10 | 13 | 15 | 18 | 20 |
| t = 0.2 mm | 0.29 | 0.32 | 0.27 | 0.21 | 0.22 | 0.23 | 0.28 | 0.21 |
| t = 0.5 mm | 0.31 | 0.29 | 0.25 | 0.21 | 0.23 | 0.25 | 0.21 | 0.22 |
| t = 0.7 mm | 0.28 | 0.25 | 0.31 | 0.29 | 0.30 | 0.21 | 0.22 | 0.23 |
| t = 1.0 mm | 0.24 | 0.35 | 0.79 | 0.81 | 0.82 | 0.88 | 0.89 | 0.87 |
| t = 1.2 mm | 0.30 | 0.31 | 0.80 | 0.83 | 0.90 | 0.88 | 0.87 | 0.89 |
| t = 1.5 mm | 0.29 | 0.32 | 0.81 | 0.92 | 0.95 | 0.95 | 0.93 | 0.94 |
| t = 1.7 mm | 0.28 | 0.30 | 0.79 | 0.83 | 0.92 | 0.95 | 0.92 | 0.98 |
| t = 2.0 mm | 0.28 | 0.30 | 0.81 | 0.83 | 0.85 | 0.88 | 0.90 | 0.92 |

It was found that, as shown in FIG. 6 and Table 2, the samples in which the area D is set to 8 $mm^2$ or greater and the thickness t is set to 1.0 mm or greater (their test results are indicated by white marks or X in FIG. 6) have very high strength ratios and are excellent in durability. Conceivably, this advantageous effect was attained because the rear end portion of the ceramic insulator had a sufficient strength against the force applied from the leg portion.

The above-described test results show that the area D is preferably set to 8 $mm^2$ or greater and the thickness t is preferably set to 1.0 mm or greater in order to more reliably prevent breakage of the ceramic insulator in ignition plugs in which the length L is set to be not less than 28 mm but not greater than 34 mm and the rear end portion of the ceramic insulator is more likely to break.

Figure 7:
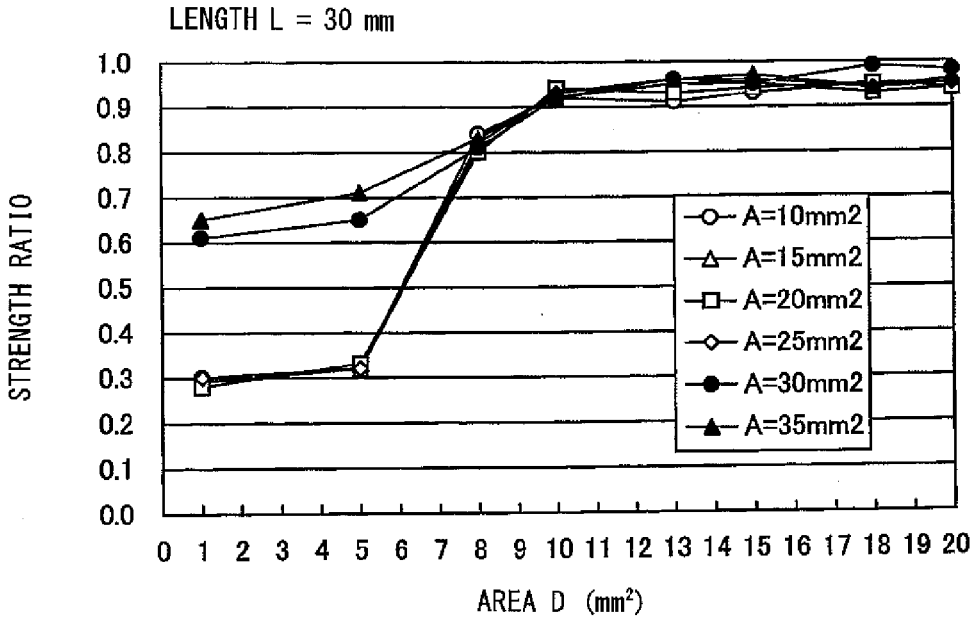
FIG. 7 is a graph showing the results of a cracking load evaluation test performed on samples in which the length L was set to 30 mm, and an area A and the area D were changed within respective ranges.
Figure 8:
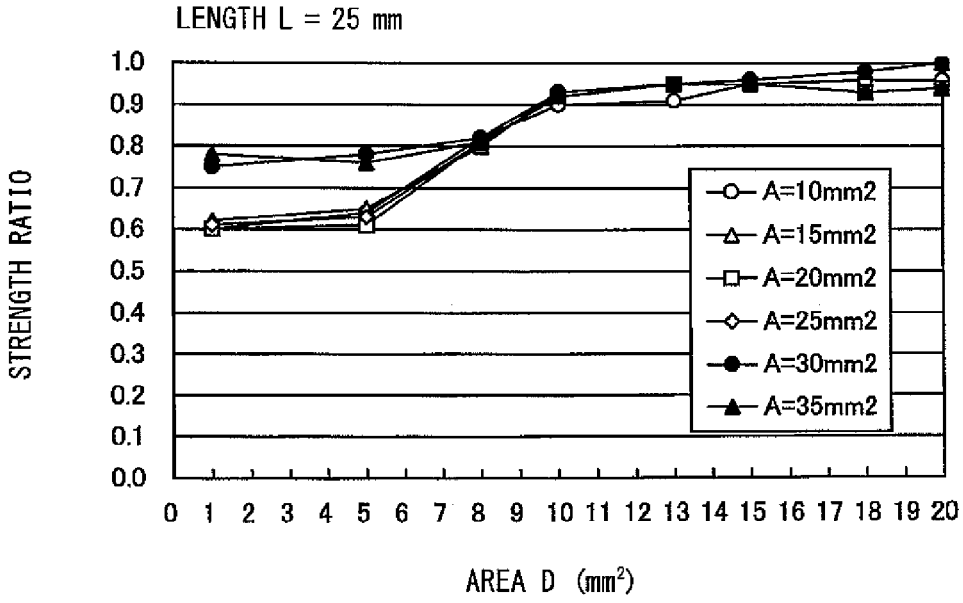
FIG. 8 is a graph showing the results of a cracking load evaluation test performed on samples in which the length L was set to 25 mm, and the area A and the area D were changed within respective ranges.

Next, there were manufactured samples of the ignition plug in which the length L was set to 30 mm or 25 mm and the area D ($mm^2$) and the area A ($mm^2$) of the flat portion of the insulator were changed within respective ranges, and the above-described cracking load evaluation test was performed on the samples. FIG. 7 shows the test results of the samples in which the length L was set to 30 mm. FIG. 8 shows the test results of the samples in which the length L was set to 25 mm.

In FIGS. 7 and 8, the test results of samples in which the area A was set to 10 $mm^2$ are indicated by white circles; the test results of samples in which the area A was set to 15 $mm^2$ are indicated by white triangles; the test results of samples in which the area A was set to 20 $mm^2$ are indicated by white squares; and the test results of samples in which the area A was set to 25 $mm^2$ are indicated by white rhombuses. Also, the test results of samples in which the area A was set to 30 $mm^2$ are indicated by black circles; and the test results of samples in which the area A was set to 35 $mm^2$ are indicated by black triangles. In each sample, the thickness t was set to 1.5 mm.

It was found that, as shown in FIGS. 7 and 8, in the case of the samples in which the area A is set to 25 $mm^2$ or less (whose test results are indicated by white marks in FIGS. 7 and 8), when the area D is set to be less than 8 $mm^2$, the strength ratio becomes low and the rear end portion of the ceramic insulator becomes more likely to occur, but when the area D is set to 8 $mm^2$ or greater, the strength ratio increases greatly, and excellent durability which is comparable to or more excellent than those of the samples in which the area A is set to be greater than 25 $mm^2$ can be realized.

In particular, it was found that, as shown in FIG. 7, in the case of the samples in which the length L is set to 28 mm or greater and the area A is set to 25 $mm^2$ or less, when the area D is set to be less than 8 $mm^2$, the strength ratio becomes very low and the rear end portion of the ceramic insulator becomes highly likely to occur, but when the area D is set to 8 $mm^2$ or greater, the strength ratio increases dramatically, and excellent durability can be realized.

The above-described test results show that the area D is preferably set to 8 $mm^2$ or greater and the thickness t is preferably set to 1.0 mm or greater in order to more reliably prevent breakage of the ceramic insulator in ignition plugs in which the area A is set to 25 $mm^2$ or less and the rear end portion of the ceramic insulator is more likely to break.

Also, in the case of ceramic insulators in which the length L is set to 28 mm or greater and the area A is set to 25 $mm^2$ or less, and the rear end portion thereof is highly likely to break, setting the thickness t to 1.0 mm or greater and setting the area D to 8 $mm^2$ or greater is considerably effective for preventing the breakage of the ceramic insulator.

Figure 9:
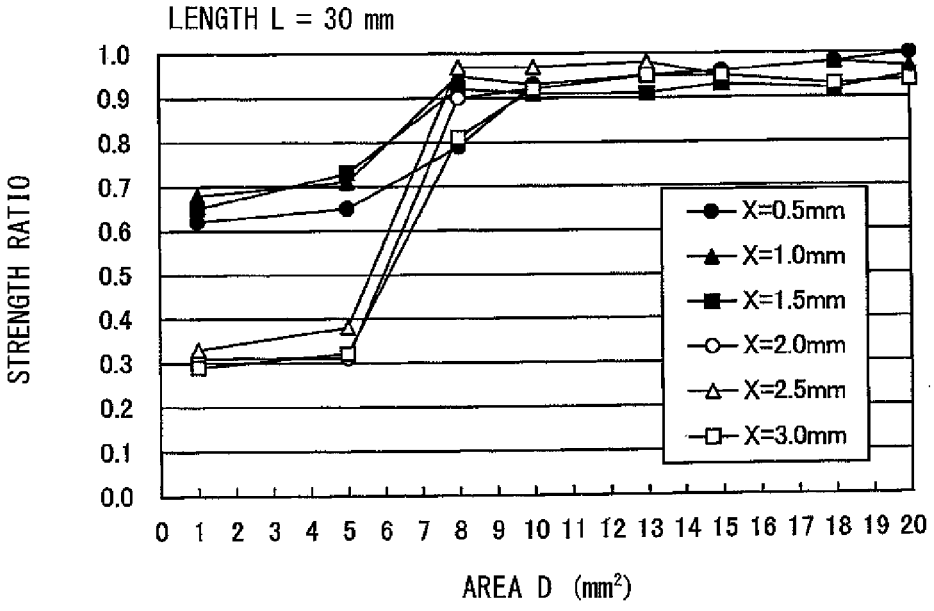
FIG. 9 is a graph showing the results of a cracking load evaluation test performed on samples in which the length L was set to 30 mm, and a thickness X and the area D were changed within respective ranges.
Figure 10:
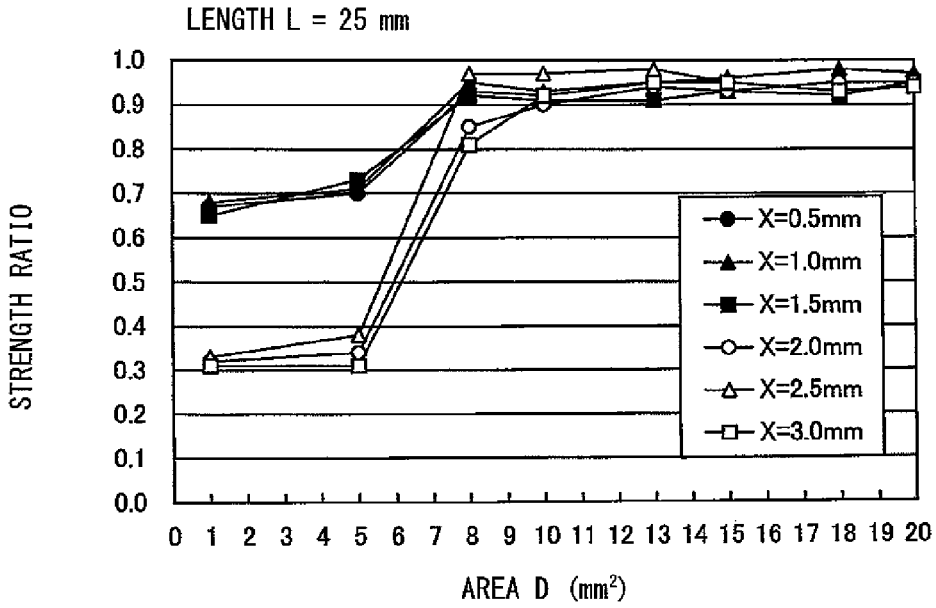
FIG. 10 is a graph showing the results of a cracking load evaluation test performed on samples in which the length L was set to 25 mm, and the thickness X and the area D were changed within respective ranges.

Next, there were manufactured samples of the ignition plug in which the length L was set to 30 mm or 25 mm, a brim portion having an outer diameter equal to or greater than the outer diameter of the forward end surface of the head portion was provided at the forward end of the head portion, and the thickness X (mm) of the brim portion along the axis was changed within a predetermined range. The above-described cracking load evaluation test was performed on the samples. FIG. 9 shows the test results of the samples in which the length L was set to 30 mm. FIG. 10 shows the test results of the samples in which the length L was set to 25 mm. Notably, in the test, the strength ratio of each sample was calculated while the cracking load of an ignition plug in which the length L was set to 27 mm, the area D was set to 20 $mm^2$, the thickness t was set to 1.5 mm was used as a reference.

In FIGS. 9 and 10, the test results of samples in which the thickness X was set to 0.5 mm are indicated by black circles; the test results of samples in which the thickness X was set to 1.0 mm are indicated by black triangles; the test results of samples in which the thickness X was set to 1.5 mm are indicated by black squares; the test results of samples in which the thickness X was set to 2.0 mm are indicated by white circles; the test results of samples in which the thickness X was set to 2.5 mm are indicated by white triangles; and the test results of samples in which the thickness X was set to 3.0 mm are indicated by white squares. In each sample, the thickness t was set to 1.5 mm. In addition, the area A was set to 30 $mm^2$ in the samples in which the length L was set to 30 mm, and the area A was set to 25 $mm^2$ in the samples in which the length L was set to 25 mm.

It was revealed that, as shown in FIGS. 9 and 10, in the case of the samples in which the thickness X is set to 2.0 mm or greater (whose test results are indicated by white marks in FIGS. 9 and 10), when the area D is set to be less than 8 $mm^2$, the strength ratio becomes very low and the rear end portion of the ceramic insulator becomes more likely to occur, but when the area D is set to 8 $mm^2$ or greater, the strength ratio increases greatly, and excellent durability can be realized.

From the above-described test results, it can be said that setting the thickness t to 1.0 mm or greater and setting the area D to 8 $mm^2$ or greater are particularly meaningful in ignition plugs in which the distance X is 2.0 mm or less (namely, a part of the head portion located within a region which extends at least 2 mm from the forward end thereof toward the rear end side with respect to the axial direction has an outer diameter greater than the outer diameter of the forward end surface of the head portion), and the rear end portion of the ceramic insulator is more likely break.

The present invention is not limited to the above-described embodiment, but may be embodied, for example, as follows. Of course, applications and modifications other than those exemplified below are also possible.

Figure 11:
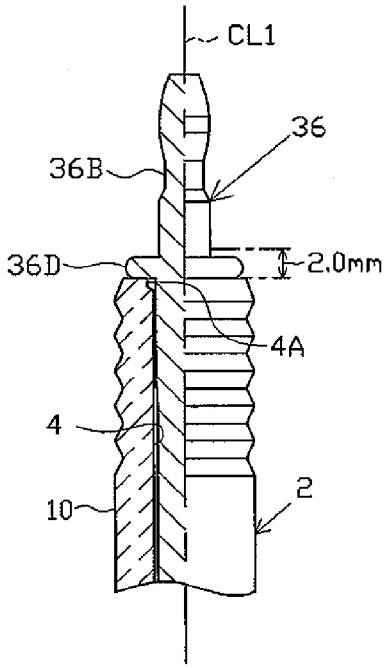
FIG. 11 is an enlarged sectional view showing the structure of the terminal electrode in another embodiment.

(a) In the above-described embodiment, the terminal electrode 6 is configured such that a part of the head portion 6B located within a region which extends at least 2 mm from the forward end thereof toward the rear end side with respect to the direction of the axial CL1 has an outer diameter greater than the outer diameter of the forward end surface of the head portion 6B. However, a terminal electrode 36 as shown in FIG. 11 may be employed. The terminal electrode 36 is configured such that a brim portion 36D projecting radially outward is provided at the forward most end of a head portion 36B, and at least a portion of the part of the head portion 36B, which part is located within a region which extends at least 2 mm from the forward end thereof toward the rear end side with respect to the direction of the axial CL1, has an outer diameter greater than the outer diameter of the forward end surface of the head portion 36B. In this case, when a load acts on the head portion 36B, the load applied from the head portion 36B to the ceramic insulator 2 can be decreased, whereby breakage at the rear end portion of the ceramic insulator 2 can be prevented more reliably.

(b) In the above-described embodiment, the grooves 31 are provided on the rear trunk portion 10; however, the grooves 31 may be omitted.

(c) In the above-described embodiment, the ignition plug 1 is configured to ignite a fuel gas (air-fuel mixture) by generating spark discharges at the spark discharge gap 28. However, the structure of the ignition plug to which the technical idea of the present invention is applicable is not limited thereto. Accordingly, the technical idea of the present invention may be applied to an ignition plug (plasma jet ignition plug) which has a cavity (space) in a forward end portion of the ceramic insulator and which jets the plasma generated in the cavity so as to ignite the fuel gas.

(d) In the above-described embodiment, the tool engagement portion 19 has a hexagonal cross section. However, the shape of the tool engagement portion 19 is not limited thereto. For example, the tool engagement portion may have a Bi-HEX (modified dodecagonal) shape [ISO22977:2005(E)] or the like.

DESCRIPTION OF REFERENCE NUMERALS

1: ignition plug
2: ceramic insulator (insulator)
2A: thinnest portion
2F: flat portion (of the ceramic insulator)
3: metallic shell
4: axial bore
5: center electrode
6: terminal electrode
6A: leg portion
6B: head portion
6F: flat portion (of the terminal electrode)
CL1: axis
PA1: projected area (of the flat portion of the ceramic insulator)
PA2: projected area (of the flat portion of the terminal electrode)

The invention claimed is:

1. An ignition plug comprising:

an insulator having an axial bore extending in a direction of an axis;

a center electrode inserted into a forward end portion of the axial bore;

a terminal electrode having a rod-shaped leg portion inserted into a rear end portion of the axial bore, and a head portion projecting from a rear end of the insulator; and a tubular metallic shell disposed around the insulator such that a portion of the insulator projects from a rear end of the metallic shell, a length L of the portion of the insulator projecting from the rear end of the metallic shell measured along the axis being not less than 28 mm but not greater than 34 mm, wherein, a thickness t of a thinnest portion of the insulator is 1.0 mm or greater within a region which extends 5.5 mm from the rear end of the insulator toward the forward end side with respect to the direction of the axis;

a forward end surface of the head portion and a rear end surface of the insulator have respective flat portions; and when the flat portion of the rear end surface of the insulator and the flat portion of the forward end surface of the head portion are projected along the axis onto a plane orthogonal to the axis, an area D of a region where a projected area of the flat portion of the rear end surface overlaps with a projected area of the flat portion of the forward end surface is set to 8 $mm^2$ or greater.

2. An ignition plug according to claim 1, wherein the flat portion of the rear end surface of the insulator has an area of 25 $mm^2$ or less.

3. An ignition plug comprising:

an insulator having an axial bore extending in a direction of an axis;

a center electrode inserted into a forward end portion of the axial bore;

a terminal electrode having a rod-shaped leg portion inserted into a rear end portion of the axial bore, and a head portion projecting from a rear end of the insulator; and a tubular metallic shell disposed around the insulator, wherein, a thickness t of a thinnest portion of the insulator is 1.0 mm or greater within a region which extends 5.5 mm from the rear end of the insulator toward the forward end side with respect to the direction of the axis;

a forward end surface of the head portion and a rear end surface of the insulator have respective flat portions;

the flat portion of the rear end surface of the insulator has an area of 25 $mm^2$ or less; and when the flat portion of the rear end surface of the insulator and the flat portion of the forward end surface of the head portion are projected along the axis onto a plane orthogonal to the axis, an area D of a region where a projected area of the flat portion of the rear end surface overlaps with a projected area of the flat portion of the forward end surface is set to 8 $mm^2$ or greater.

4. An ignition plug according to any one of claims 1 to 3, wherein a part of the head portion located within a region which extends at least 2 mm from the forward end of the head portion toward the rear end side with respect to the direction of the axis has an outer diameter equal to or greater than that of the forward end surface of the head portion.

* * * * *